US010610034B2

(12) United States Patent
Sturgeon et al.

(10) Patent No.: US 10,610,034 B2
(45) Date of Patent: Apr. 7, 2020

(54) EASY CHANGE MATTRESS SHEET ATTACHMENT SYSTEM

(71) Applicants: Xiaolu Huang Sturgeon, Thornton, CO (US); Gregory Cecil Sturgeon, Thornton, CO (US)

(72) Inventors: Xiaolu Huang Sturgeon, Thornton, CO (US); Gregory Cecil Sturgeon, Thornton, CO (US)

( * ) Notice: Subject to any disclaimer, the term of this patent is extended or adjusted under 35 U.S.C. 154(b) by 112 days.

(21) Appl. No.: 15/956,845

(22) Filed: Apr. 19, 2018

(65) Prior Publication Data

US 2018/0303256 A1 Oct. 25, 2018

Related U.S. Application Data

(60) Provisional application No. 62/490,006, filed on Apr. 25, 2017.

(51) Int. Cl.

| | |
|---|---|
| ***A47G 9/04*** | (2006.01) |
| ***A47G 9/02*** | (2006.01) |
| ***A47C 21/02*** | (2006.01) |
| ***A47C 21/06*** | (2006.01) |
| *A44B 13/00* | (2006.01) |

(52) U.S. Cl.

CPC ..... *A47G 9/04* (2013.01); *A47C 21/022* (2013.01); *A47C 21/028* (2013.01); *A47C 21/06* (2013.01); *A47G 9/0246* (2013.01); *A47G 9/0292* (2013.01); *A44B 13/0052* (2013.01)

(58) Field of Classification Search

CPC .. A47G 9/0246; A47G 9/0238; A47G 9/0292; A47G 9/02; A47G 9/04; A47G 9/00; A47C 31/105; A47C 21/022; A47C 21/028; A47C 21/02; A47C 21/06; Y10T 24/23

USPC ..... 5/488, 496, 498, 497, 482; 24/72.5

See application file for complete search history.

(56) References Cited

U.S. PATENT DOCUMENTS

| | | | | |
|---|---|---|---|---|
| 2,214,074 A | | 9/1940 | Clarke | |
| 2,459,497 A | * | 1/1949 | Calabro | A47C 21/022 24/72.5 |
| 2,630,588 A | | 3/1953 | Levin | |
| 2,804,632 A | | 9/1957 | Ford | |
| 2,857,643 A | | 10/1958 | Tomsic | |
| 2,886,833 A | * | 5/1959 | Enger | A47C 31/105 5/496 |

(Continued)

FOREIGN PATENT DOCUMENTS

CA 2715399 8/2009

*Primary Examiner* — Robert G Santos

(74) *Attorney, Agent, or Firm* — Trenner Law Firm, LLC; Mark D. Trenner

(57) ABSTRACT

An example easy change mattress sheet attachment system includes a bed sheet having four sewn-on fabric casings in an arch shape and a cord inserted through the casings forming a set of accessible sections of drawstring at exposed between-casing cord regions at four corners, and a bottom mat having means for trapping drawstrings at four corners. After having installed the bottom mat under the mattress, one can install and remove the top sheet onto and from the mattress without having to lift up the mattress. To install the top sheet, first put the top sheet on the mattress, then execute drawstring-trapping maneuvers at four bed corners. To remove the top sheet, detach the engaged drawstrings at four bed corners.

20 Claims, 14 Drawing Sheets

(56) References Cited

U.S. PATENT DOCUMENTS 3,144,666 A 8/1964 Ragsdale Mazera et al.
3,381,320 A 5/1968 Mott
3,739,408 A 6/1973 Pagels
3,965,504 A 6/1976 Ainsworth
4,040,133 A 8/1977 Gilreath
4,199,830 A * 4/1980 Ogata ..... A47C 21/022 24/72.5
4,461,049 A 7/1984 Hammond
4,488,323 A 12/1984 Colburn
4,495,233 A * 1/1985 Bassetti ..... A47G 9/0246 428/102
4,620,396 A 11/1986 Bjorntwedt
4,642,826 A * 2/1987 Bassetti ..... D05B 25/00 5/496
4,654,906 A 4/1987 Roberts
4,662,013 A 5/1987 Harrison
4,727,608 A * 3/1988 Joyce ..... A47G 9/0246 24/712
4,777,894 A * 10/1988 Joyce ..... A47G 9/0246 112/475.06
4,825,489 A 5/1989 Ross
4,916,766 A 4/1990 Grandy
4,970,744 A * 11/1990 Davis ..... A47G 9/0246 5/496
5,020,177 A * 6/1991 Etherington ..... A47G 9/02 5/496
5,029,353 A 7/1991 Kimball et al.
5,046,207 A * 9/1991 Chamberlain ..... A47G 9/0246 5/496
D323,442 S 1/1992 Trader
5,148,560 A * 9/1992 Torres ..... A47C 21/022 24/72.5
5,325,554 A * 7/1994 Lewis ..... A47C 21/022 5/496
5,375,280 A 12/1994 O'Sullivan et al.
5,513,403 A 5/1996 Wooten, Jr.
5,528,780 A 6/1996 Taylor
5,557,814 A 9/1996 Cybulski
5,566,411 A 10/1996 Eiler
5,572,754 A 11/1996 Lazar et al.
5,628,077 A * 5/1997 Briganti ..... A47G 9/0246 5/496
5,651,153 A * 7/1997 Goodrich ..... A47C 21/022 24/72.5
D436,281 S 1/2001 Thompson
D436,489 S * 1/2001 Farrugia ..... D6/607
6,243,895 B1 6/2001 Amin
6,276,009 B1 8/2001 Schrougham
6,757,923 B2 7/2004 Sopher et al.
6,823,543 B2 11/2004 Diak/Ghanem
6,859,962 B2 3/2005 Diak/Ghanem
7,107,635 B2 9/2006 Henry et al.
7,703,156 B2 * 4/2010 Lee ..... A47C 31/10 219/212
8,032,959 B2 * 10/2011 Rowson ..... A47G 9/02 5/488
8,074,313 B2 * 12/2011 Marcangelo ..... A47C 21/022 5/690
8,117,692 B1 2/2012 Richards
8,458,837 B2 * 6/2013 Marcangelo ..... A47C 31/00 5/690
D686,848 S 7/2013 Waite et al.
8,607,383 B2 * 12/2013 Briganti ..... A47G 9/0246 5/496
8,627,521 B2 1/2014 Rowson et al.
D698,585 S 2/2014 McClutchen
D700,791 S 3/2014 Curtis
8,707,482 B1 4/2014 Ramthun
D708,869 S 7/2014 Mun
D714,077 S 9/2014 Mun
D715,582 S 10/2014 Mun
8,856,984 B1 * 10/2014 Donham ..... A47G 9/0246 5/496
D769,030 S * 10/2016 Acres ..... D6/607
9,492,022 B2 * 11/2016 Nekhala ..... A47G 9/0246
9,545,164 B2 * 1/2017 Tulloch ..... A47G 9/0246
9,907,419 B1 3/2018 Mun
10,104,981 B2 * 10/2018 Nekhala ..... A47G 11/004
D832,619 S 11/2018 Pacquette
10,285,518 B1 * 5/2019 Nekhala ..... A47G 9/04
10,368,654 B2 8/2019 Sopher
10,517,412 B1 * 12/2019 Nekhala ..... A47G 9/04
2002/0062522 A1 * 5/2002 Deckert ..... A47C 21/022 5/504.1
2002/0116763 A1 8/2002 Weir et al.
2003/0019037 A1 * 1/2003 Michaelis ..... A47G 9/02 5/497
2004/0031100 A1 2/2004 Creech
2004/0139547 A1 7/2004 Wootten, Jr.
2006/0107461 A1 5/2006 Wootten, Jr.
2008/0028522 A1 * 2/2008 Atwood ..... A47G 9/0246 5/496
2008/0155749 A1 7/2008 Stevens
2008/0289104 A1 * 11/2008 Rowson ..... A47G 9/02 5/482
2009/0106900 A1 4/2009 Wootten, Jr.
2009/0106901 A1 4/2009 Wootten, Jr.
2009/0106902 A1 4/2009 Wootten, Jr.
2009/0126109 A1 * 5/2009 Lee ..... A47C 31/10 5/421
2010/0269743 A1 * 10/2010 Marcangelo ..... A47C 21/022 112/2.1
2011/0061165 A1 3/2011 Falconetti et al.
2011/0131724 A1 * 6/2011 Marcangelo ..... A47C 31/00 5/498
2011/0302715 A1 12/2011 Battaglia et al.
2011/0314603 A1 * 12/2011 Rowson ..... A47G 9/02 5/488
2012/0167309 A1 7/2012 Heidorn
2012/0227183 A1 9/2012 Muskelly
2012/0324646 A1 * 12/2012 Briganti ..... A47G 9/0246 5/496
2013/0254990 A1 10/2013 Kim
2014/0075672 A1 3/2014 Marcik
2014/0150181 A1 * 6/2014 Tulloch ..... A47G 9/0246 5/496
2014/0298585 A1 10/2014 Grama et al.
2014/0317845 A1 10/2014 Smith
2015/0013067 A1 1/2015 Coughlin
2015/0026888 A1 1/2015 Tarquinio
2015/0040316 A1 2/2015 Graves
2016/0007774 A1 * 1/2016 Kakabeeke ..... A47G 9/0246 5/496
2016/0174738 A1 * 6/2016 Nekhala ..... A47G 9/0246 5/496
2017/0035210 A1 * 2/2017 Nekhala ..... A47G 11/004
2017/0112292 A1 4/2017 Sopher
2018/0303256 A1 * 10/2018 Sturgeon ..... A47G 9/04

* cited by examiner

EASY CHANGE MATTRESS SHEET ATTACHMENT SYSTEM

CROSS REFERENCE TO RELATED APPLICATIONS

This application claims the priority benefit of U.S. Provisional Patent Application No. 62/490,006 filed Apr. 25, 2017 for "Easy Change Mattress Sheet Attachment System" of Xiaolu Huang Sturgeon, which is incorporated by reference in its entirety as though fully set forth herein.

BACKGROUND

An ideal mattress bed sheet may be installed and removed easily while providing a tight, neat and secure fit on a mattress. Conventional fitted sheets that are widely used on bed mattresses are definitely not ideal. These fitted sheets have elastic material around four corner edges to contract on the underside of the mattress so to secure the fitted sheet in places. To name a few problems of these fitted sheet: first, one needs to lift up mattress corners in order to lodge the sheet corner piece underneath the mattress; second, the fitted sheet corner is easily dislodged due to the built-in elastic material losing its elasticity over wear and tear; third, one off-the-shelf fitted sheet size cannot fit mattresses of various heights and geometries; fourth and definitely not the last, changing these sheets on cornered bed or on bunk beds can be tedious job for anyone.

Nowadays, popular high-rise mattresses and popular usage of mattress top accessories such as foam pad or mattress protectors have added challenges for conventional fitted sheets, not to mention the shrinkage of sheets after washing and drying and having to lift heavier-than-ever mattresses. Sheet-changing is even bigger a problem for physically challenged people including seniors who want to live an independent life and for hotel and hospital personal who have to change a large amount of bed sheets per day.

DETAILED DESCRIPTION

An example bed sheet system comprises a top sheet having a plurality of sewn-on drawstring casings with each casing spanning a mattress side panel longitudinally having openings at both ends at a bed corner, a drawstring cord for being inserted through the casings forming accessible sections of drawstring at exposed between-casing regions, and a bottom mat configured to lay under the mattress having means for trapping accessible sections of drawstring at four bed corners.

An example of the easy change mattress sheet attachment system provides a better bed sheet system that is easy and quick to install and to remove by not requiring lifting of the mattress; covers the mattress taut and securely by using an attachment means with drawstring; is easy to execute because it only requires simple and easy drawstring attachment maneuvers at four bed corners; is flexible to fit mattresses of various geometries and situations; is aesthetically pleasant as the visible parts of the mattress are smoothly and snuggly covered by one piece of top sheet; and is easy to handle because only the top sheet needs to be washed and the top sheet contains merely fabric and cord. Other advantages of one or more aspects will be apparent from a consideration of the drawings and ensuing description.

Before continuing, it is noted that as used herein, the terms "includes" and "including" mean, but is not limited to, "includes" or "including" and "includes at least" or "including at least." The term "based on" means "based on" and "based at least in part on."

It is also noted that as used herein, the terms "drawstring", "cord" and "drawstring cord" all bear the same meaning, and these terms are used interchangeably herein.

An example of the easy change mattress sheet attachment system disclosed herein provides a bed sheet system that fits over mattresses tightly and neatly during use and one can easily and quickly install and remove the sheet. This sheet system improves the sheet mounting process by eliminating the need of lifting mattresses and by employing the convenient attachment devices with drawstring. This sheet system not only is easy to use, but also provides tight and aesthetically attractive full coverage over a mattress. It also enables flexible fitting to mattresses of various sizes and geometries. It provides easy sheet attachment solution for people who want to arrange an aesthetically pleasant bed without much effort, especially for elderly and people with disabilities who want to lead an independent life. It also makes sheet changing much easier for bunk bed users and for people who have beds positioned at a corner.

FIG. 1 to FIG. 19, FIG. 20A, and FIG. 21A show an example of the easy change mattress sheet attachment system.

Figure 1:
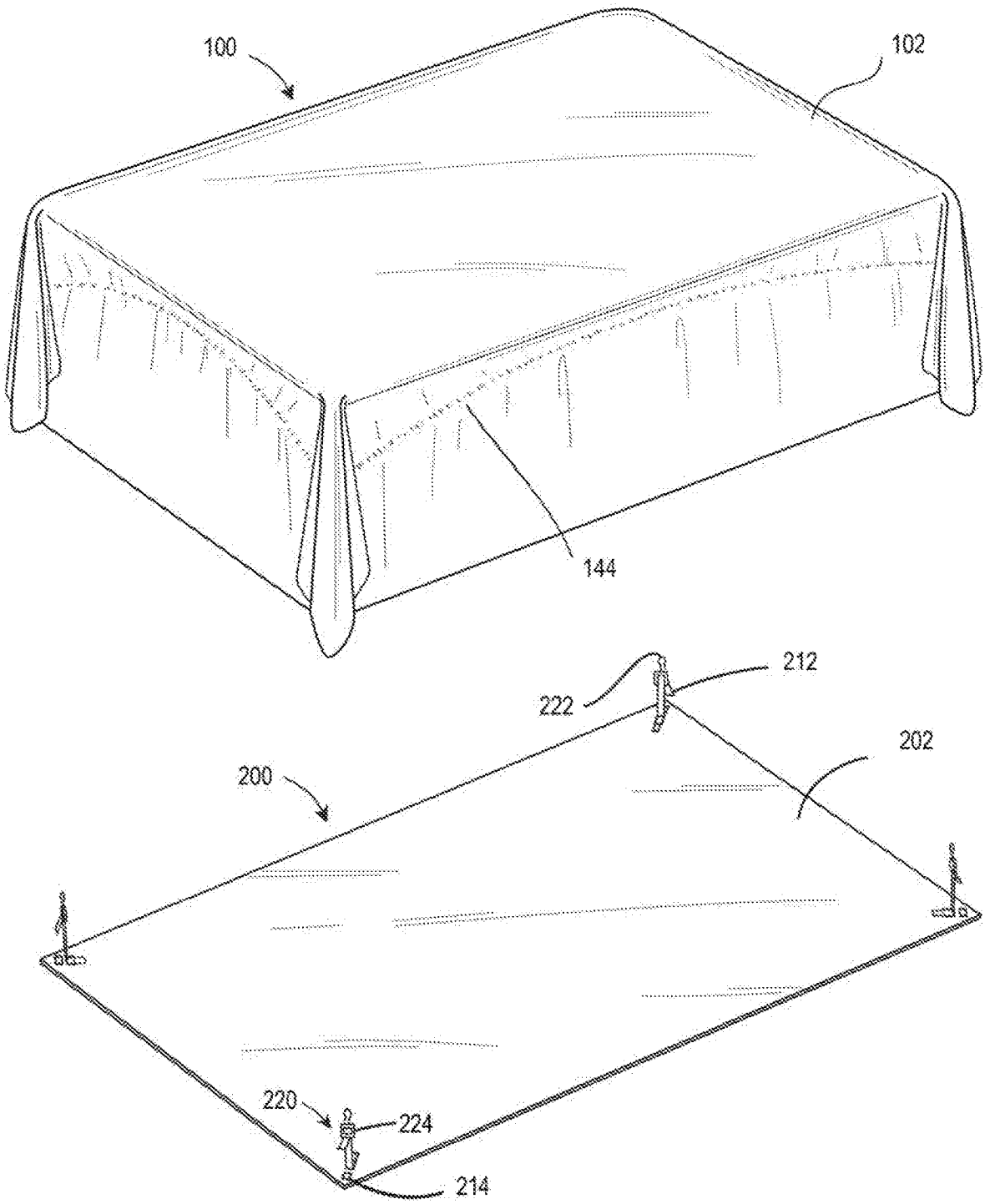
FIG. 1 is an exploded perspective view of an example easy change mattress sheet attachment system including a bottom mat and a top sheet.
Figure 2:
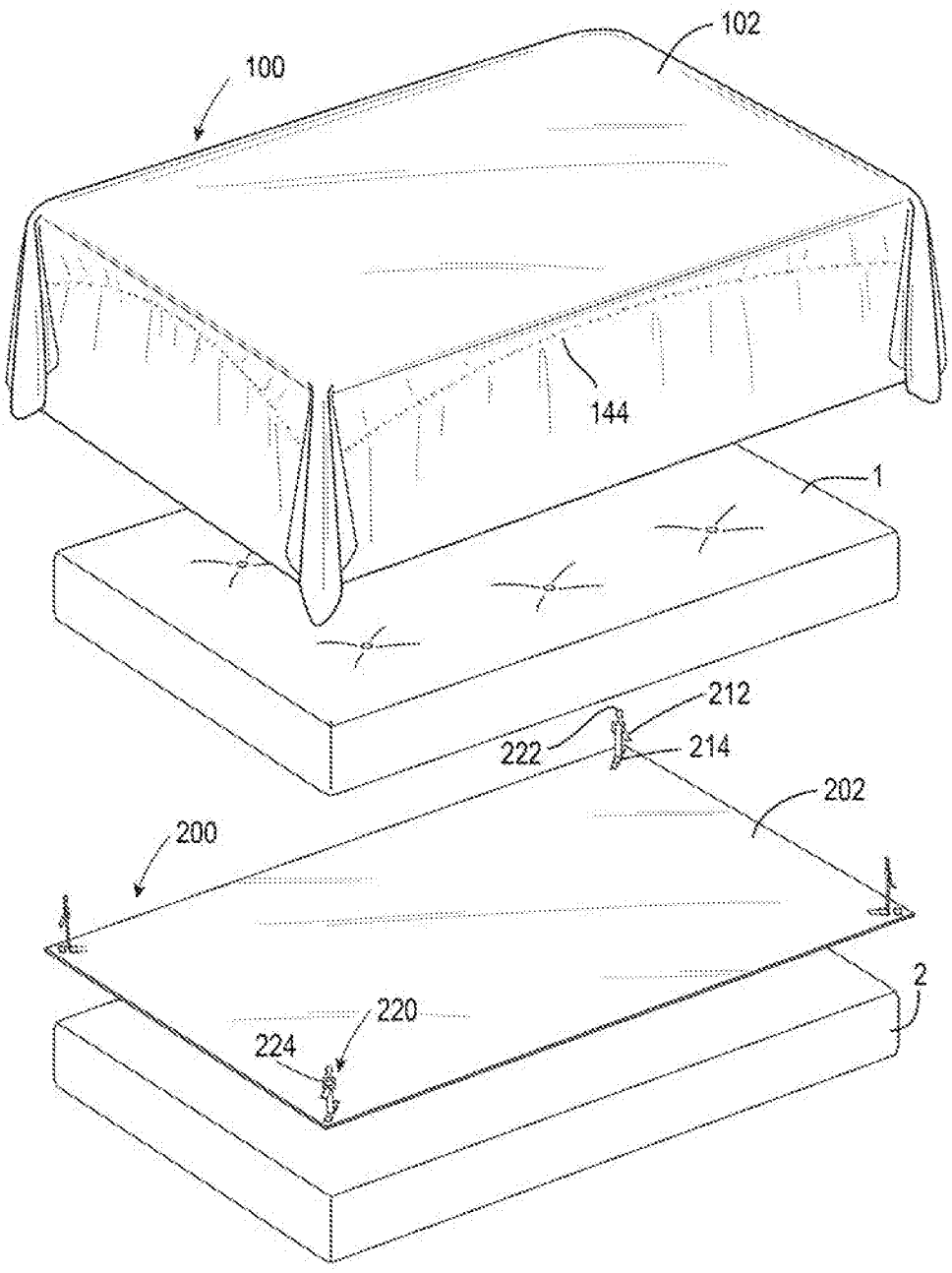
FIG. 2 is an exploded perspective view of the sheet attachment system of FIG. 1 also showing a mattress and a box spring.

As shown in FIG. 1, the example easy change mattress sheet attachment system includes top sheet 100 and bottom mat 200. FIG. 2 shows the example system of FIG. 1 plus a mattress and a box spring, from top to bottom, top sheet 100, mattress 1 (not part of the sheet system), bottom mat 200, and box spring 2 (not part of the sheet system). FIGS. 5 to 9 show various views of sheet system of FIGS. 1-2 when it is properly assembled onto the bed. It is noted that as used herein, unless specifically declared, the sheet system, top sheet and bottom mat mentioned hereafter all refer to the example of FIG. 1.

Figure 4:
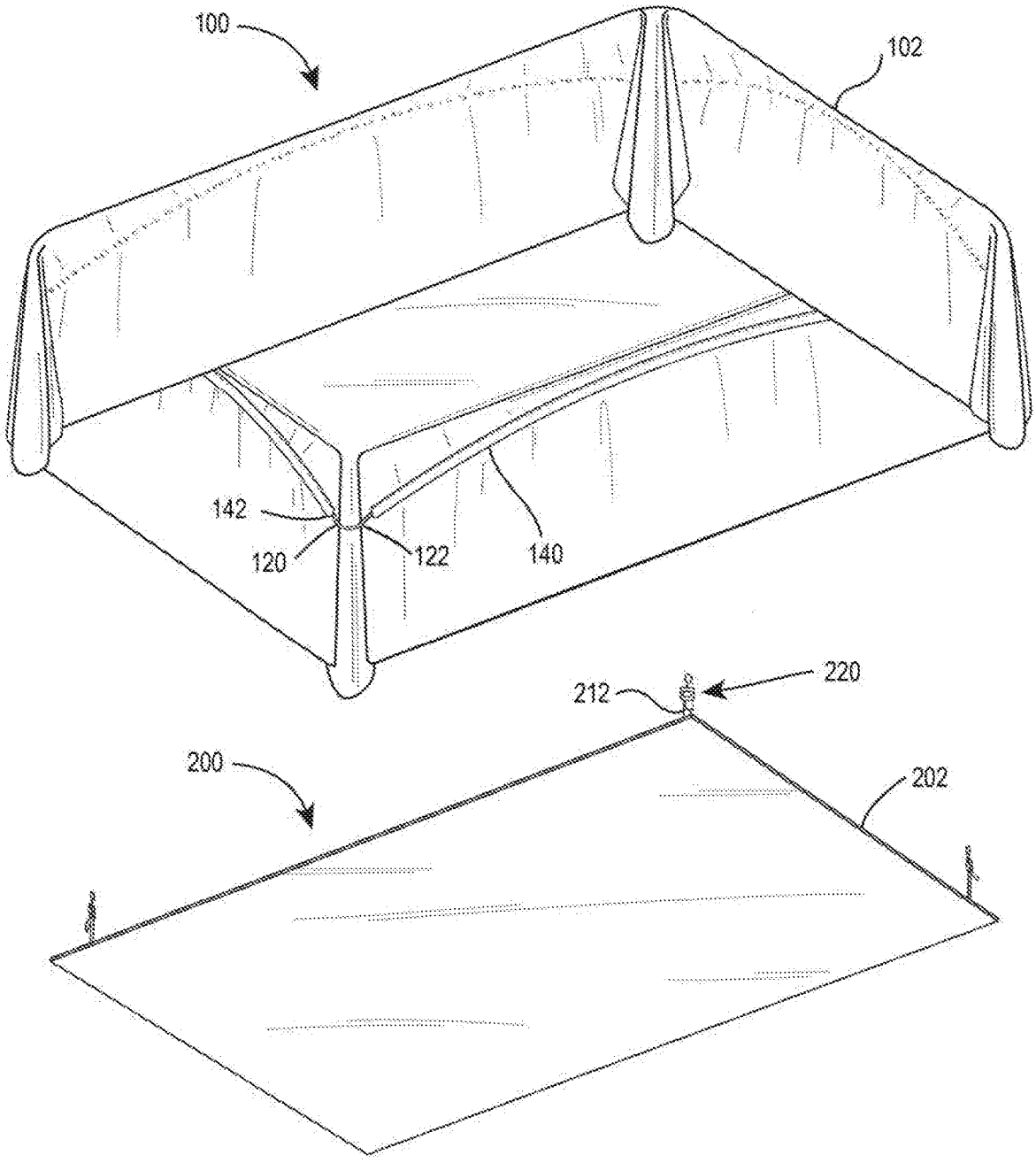
FIG. 4 is a bottom perspective view of the system of FIG. 1.
Figure 9:
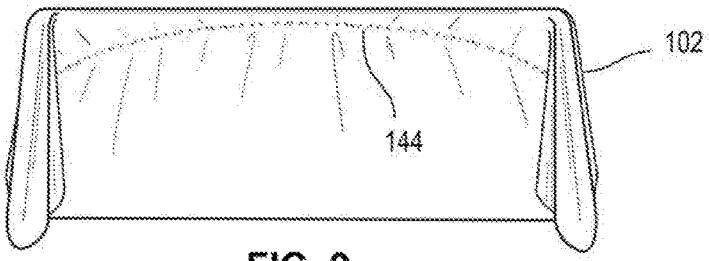
FIG. 9 is a back view of the mattress-associated top sheet of the system of FIGS. 1-3.
Figure 8:
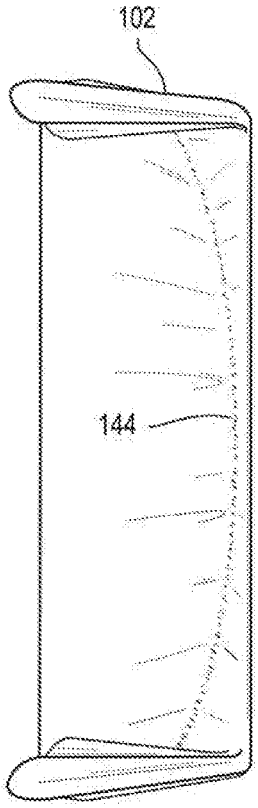
FIG. 8 is a left side view of the mattress-associated top sheet of the system of FIGS. 1-3.
Figure 5:
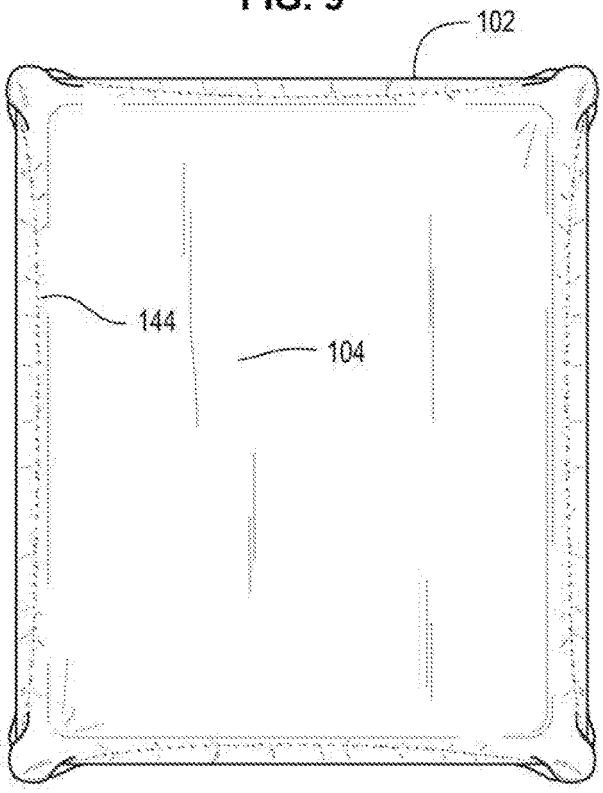
FIG. 5 is a top down view of the mattress-associated top sheet of the system of FIGS. 1-3.
Figure 6:
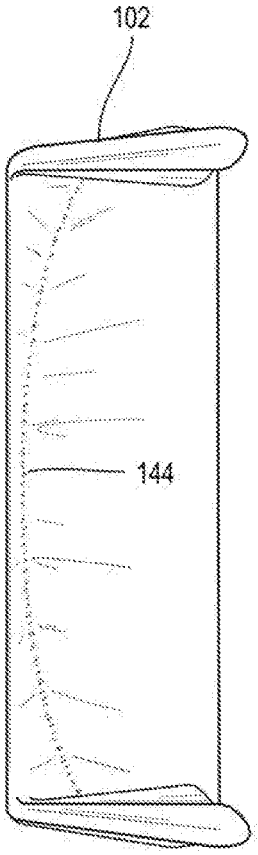
FIG. 6 is a right side view of the mattress-associated top sheet of the system of FIGS. 1-3.
Figure 7:
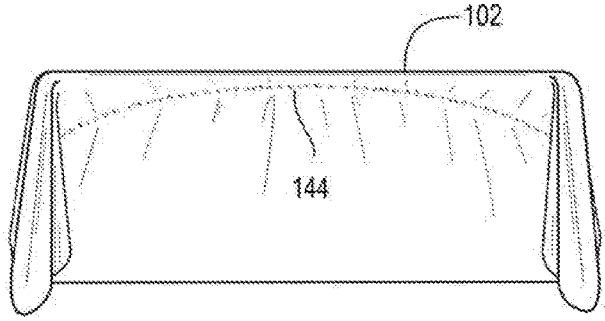
FIG. 7 is a front view of the mattress-associated top sheet of the system of FIGS. 1-3.
Figure 10:
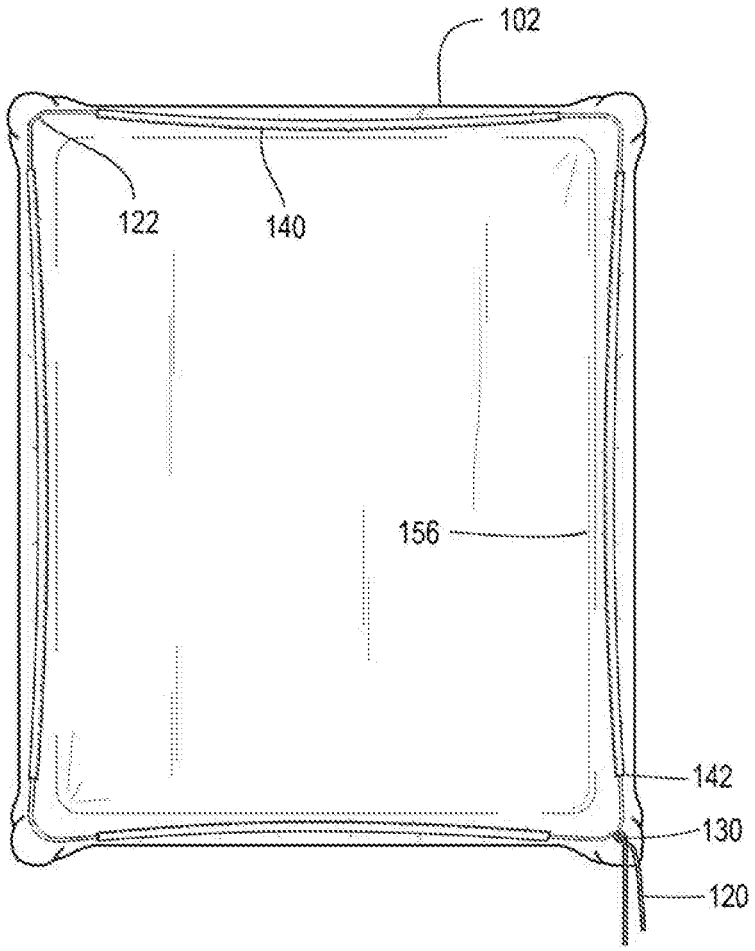
FIG. 10 is a bottom view the mattress-associated top sheet of the system of FIGS. 1-3 without showing the mattress.
Figure 15:
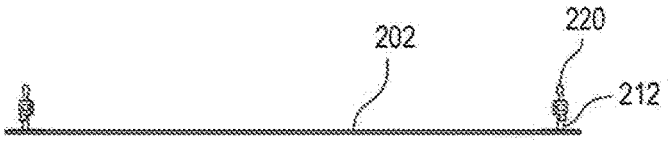
FIG. 15 is a back view of the bottom mat of the system of FIG. 1.
Figure 14:
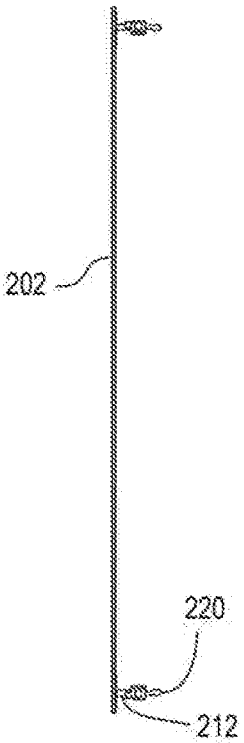
FIG. 14 is a left side view of the bottom mat of the system of FIG. 1.
Figure 19:
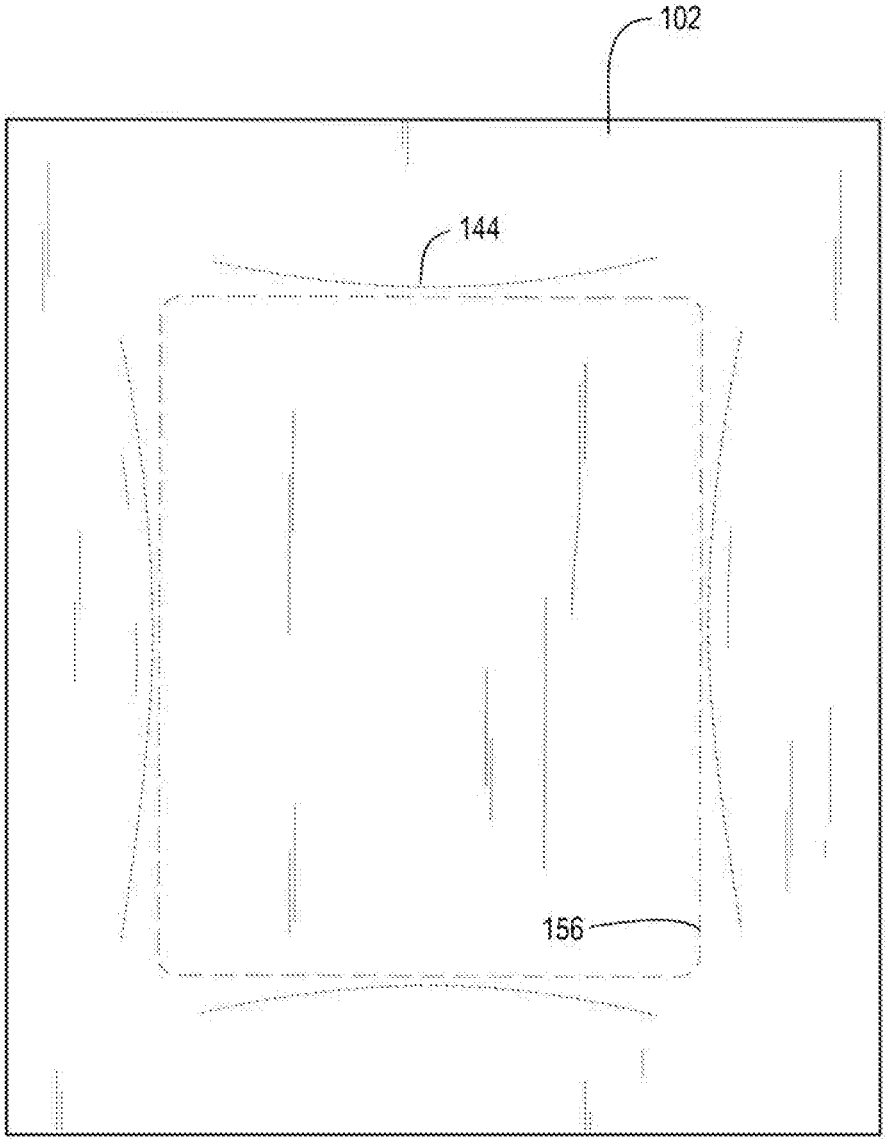
FIG. 19 is a top down view of the topside of the top sheet of the system of FIG. 1 in a substantially flattened configuration.
Figure 20A:
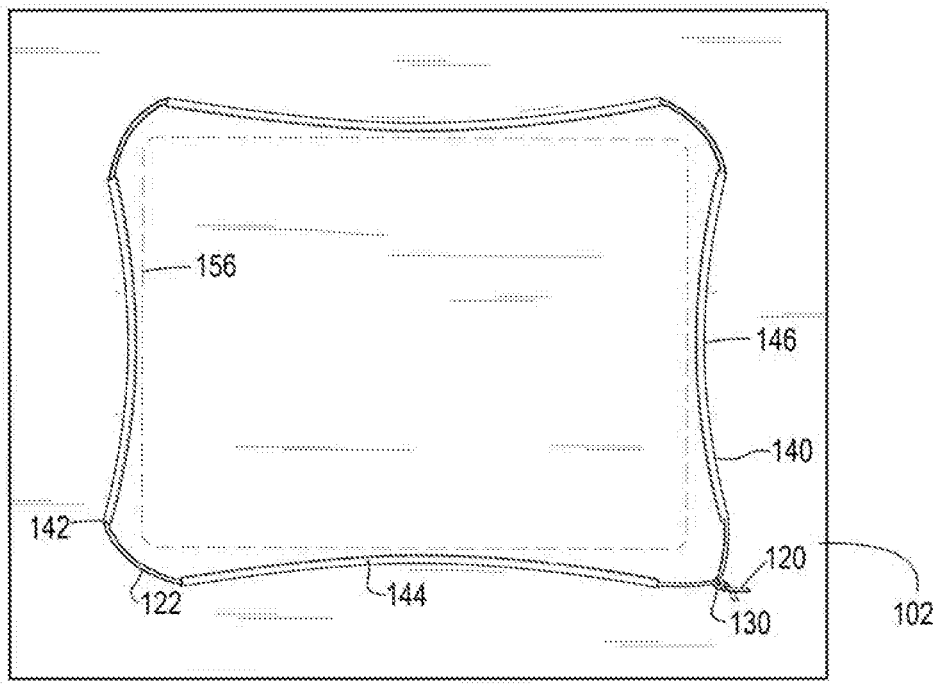
FIG. 20A is a top view of the underside of the flattened top sheet of FIG. 19.

Referring to FIGS. 19 and 20A, top sheet 100 has one large flat fabric sheet 102, four cord casings 140, and one long cord 120 inserted through all cord casings 140. FIGS. 1 and 2 show the topside of top sheet 100 in the mattress-associated state and FIG. 19 shows the topside of top sheet 100 as one flat piece of fabric 102 large enough to cover not only the top panel of mattress 1 illustrated as the outline of mattress 156, but also all side panels of mattress 1, even four side panels of box spring 2. Flat sheet 102 could be a rectangle with right-angled corners or with round corners. FIG. 4 is a bottom perspective view of the system of FIG. 1 and shows the underside of top sheet 100 has cord casings 140 and accessible sections of drawstring 122 formed by drawstring 120. FIG. 1 and FIG. 10 show that topside of top sheet 100 has stitch marks 144 at regions that cover mattress side panels and the relative size and the position of mattress top panel are shown as mattress outline 156 in FIG. 10. These stitch marks 144 are there because of the sewn-on cord casings 140 on the underside of top sheet 100 and do not affect the overall integrity of top sheet 100 with the use of stitching thread of matching color.

Four cord casings 140 are sewn onto the underside of sheet 102 at the regions that cover mattress side panels. When the top sheet is associated with the mattress, each casing 140 spans longitudinally across one mattress side panel and has openings 142 at both ends for cord 120 to be inserted through. FIG. 10 shows that, when the top sheet 100 is in the mattress-associated state, each casing opening 142 is located close to its relative mattress corner.

Referring to FIG. 20A, cord casing 140 is sewn onto the underside of top sheet 100 in the shape of a symmetric arch with the apogee 146 in the middle. FIGS. 1-2, 5-9 and 19 show the arched stitch marks 144 of casing 140 on the opposite topside of top sheet 100. The arch shape of casing 140 is for strengthening the pulling force of the top sheet 100 on the middle sections of the mattress top edges and these regions are always the loosest sections with the weakest pulling tension for conventional fitted sheets. Cord casing 140 may be made with ready-to-be-sewn-on fabric bias tape, but other materials are also suitable.

Referring to FIG. 20A, cord 120 is long and has been inserted through all casings 140, and its between-casing regions at corners are exposed and form accessible sections of drawstring 122. Accessible sections of drawstring 122 are formed where cord 120 exits one casing at its casing opening 142 and enters the adjacent casing through its casing opening 142. Accessible sections of drawstring 122 at four corners of top sheet 100 serve as the upper attachment means for pulling top sheet 100 taut onto the mattress. For a ready-to-use sheet system, cord 120, being inserted through all cord casings 140, is peripheral about the mattress sides and tighten the mattress sides with nontrivial tension just by itself without being engaged with any lower attachment means. When all accessible drawstring sections 122 are pulled down and tightly attached onto the mating lower attachment means on bottom mat 200, the region of top sheet 100 that covers the mattress top panel is pulled downward and to the corner, thus the mattress top panel is covered taut.

The arched path of the cord, similar to the catenary on a suspension bridge, allows the tension in the cord to induce a downward component of force at every point along its length, especially around the middle of the mattress top edges when the sheet is fully engaged with the mattress. The system pulls the sheet taut across the sleeping surface as the sheet envelopes and secures the mattress to the bed frame. Through arch-shaped cord casings 140, cord 120 also provides substantial downward pulling force on the regions of top sheet 100 that cover the middle sections of the mattress top edges. Cord 120 could be made by a durable ⅛ inch elastic shock cord, but other materials are also suitable. The ends of cord 120 may be tied closed, or be held together via cord locks 130, or be held together via any other means.

Figure 11:
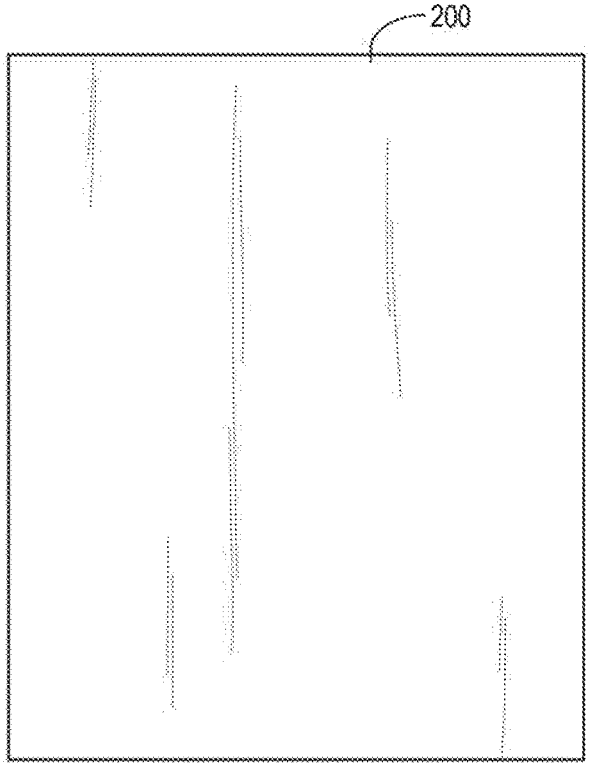
FIG. 11 is a bottom view of the bottom mat of the system of FIG. 1.
Figure 12:
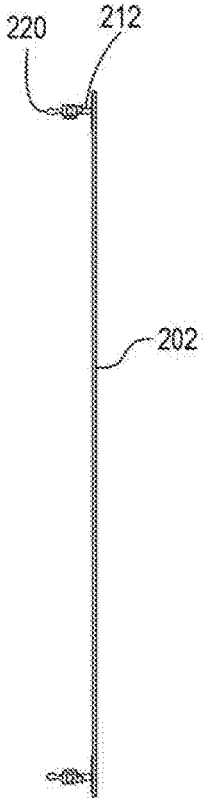
FIG. 12 is a right side view of the bottom mat of the system of FIG. 1.
Figure 13:
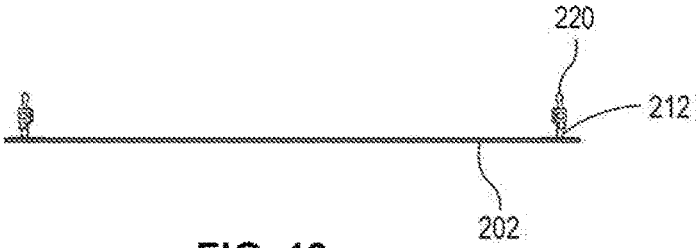
FIG. 13 is a front view of the bottom mat of the system of FIG. 1.

FIGS. 1-2, 4, and 11-15 provide views of bottom mat 200 at various angles. FIGS. 1-2 and 4 provide general and bottom up perspective views, FIG. 11 provides the top down view, and FIGS. 12-15 provide views from the sides. Bottom mat 200 has one piece of flat mat 202 and four lower attachment means. Bottom mat 200 is to be positioned under a bed mattress with the lower attachment means located at each corner. Flat mat 202 is about the size and shape of the bottom panel of mattress 1 and could be made using a rigid and slip-resistant fabric material, but other materials are also suitable.

Figure 16:
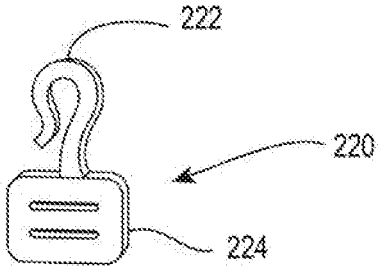
FIG. 16 is a perspective view of a buckle-hook having a hook and a buckle in one piece with the hook part for trapping a drawstring and the buckle part for adjusting hook position via a strap.
Figure 17:
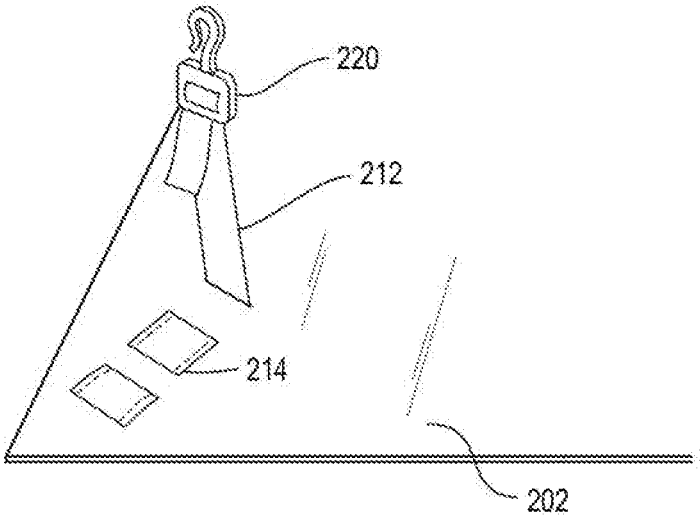
FIG. 17 is a perspective view of a corner of the bottom mat of FIG. 1 including a sewn-on strap, a set of sewn-on belt loops and the buckle-hook of FIG. 16 being mounted onto the strap.

The lower attachment means on bottom mat 200 is an adjustable drawstring-trapping device having buckle-hook 220, strap 212 and a set of belt loops 214. Referring to FIG. 16, buckle-hook 220 includes buckle 224 and hook 222 as one piece. Hook 222 is for fastening accessible drawstring sections 122 of top sheet 100, while buckle 224, when mounted onto strap 212, is for adjusting the position of hook 222. FIG. 17 shows that strap 212 has one end being slid through buckle-hook 220 and the other end being sewn on bias onto a corner region of bottom mat 200. The position of hook 222 is flexible through adjusting the length of strap 212 via buckle 224. FIG. 17 shows a set of belt loops 214 being sewn on bias at the corner of bottom mat 200 to accommodate mattresses of various shapes and geometries. As is shown in FIG. 18, by inserting strap 212 through a belt loop 214, one can stabilize the position of the lower part of strap 212 which is underneath the mattress and makes that part corner-bound.

Figure 18:
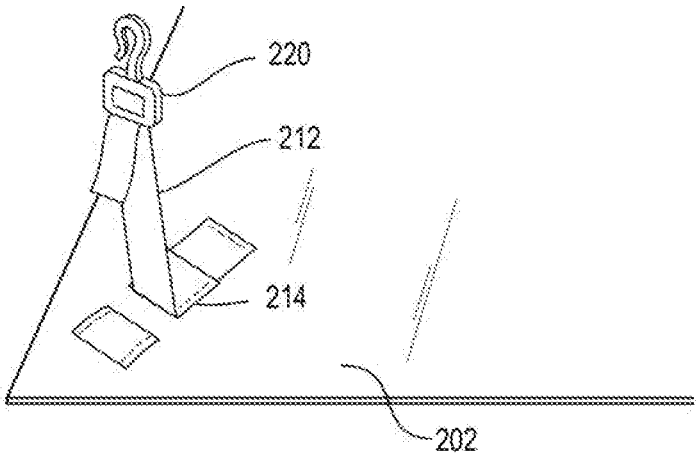
FIG. 18 is a perspective view of a corner of the bottom mat of FIG. 17 showing the strap is inserted through a sewn-on belt loop and is inserted through the buckle-hook.

As is illustrated in FIGS. 16 to 18, this lower attachment means not only is for attaching to accessible sections of drawstring 122 of top sheet 100, but also is for improving fitting flexibility to top sheet 100 so that it can fit onto mattresses of various geometric shapes and heights. Strap 212 could be wide or narrow elastic material or of any other material and buckle-hook 220 could be made of durable plastic or of any other material, and buckle-hook 220 can have buckle and hook as one piece or as separate pieces. In FIG. 18, the size of hook opening of hook 222 is less than the diameter of cord 120 preventing accessible sections of drawstring 122 from easily slipping out of hook 222.

Figure 3:
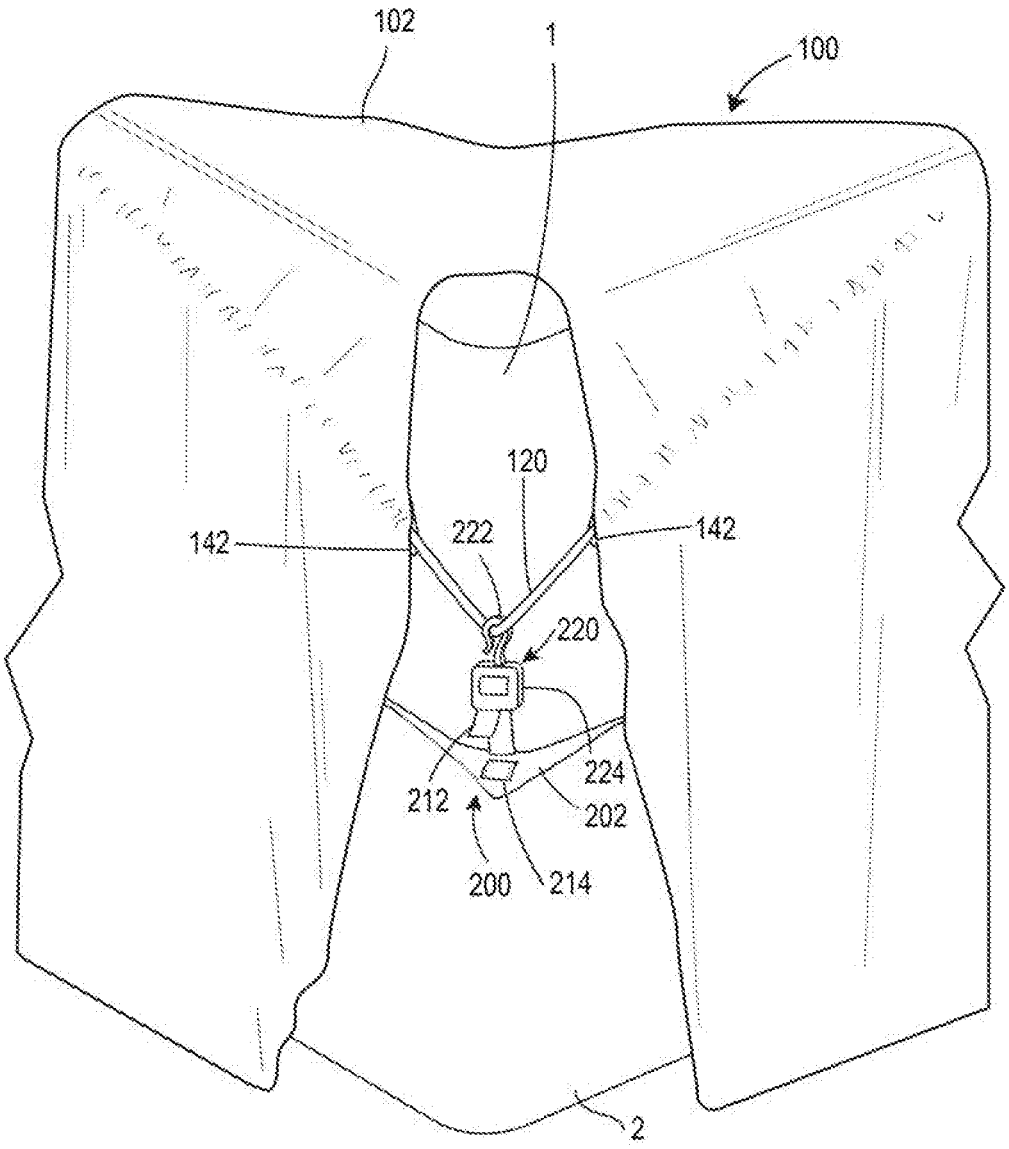
FIG. 3 is a partial perspective view of a corner of the constructed sheet system of FIG. 2 with a piece of top sheet removed for revealing the upper and lower attachment means connecting with each other.

FIG. 3 is a partial sectional view of a bed corner showing the sheet system in its fully-mattress-associated state with a piece of top sheet removed in order to expose the upper and lower attachment means in a mounted state. FIG. 3 provides a clear presentation of the well-mounted attachment device that holds top sheet 100 taut over a mattress. As is illustrated in FIG. 3, the upper attachment means on the underside of top sheet 100 include accessible sections of drawstring 122 formed by the exposed between-casing sections of cord 120 where cord 120 exits one casing at its casing opening 142 and enters the adjacent casing through its casing opening 142.

As is illustrated in FIG. 3, an accessible section of drawstring 122 has been pulled down and is fastened onto hook 222 of buckle-hook 220 on bottom mat 200. When hook 222 position is properly adjusted on strap 212, hook 222 pulls accessible drawstring section 122 taut downwards and towards the corner at four bed corners, thus draws the mattress top and sides tight. The arch shape of cord casings 140 with apogee in the middle strengthens the pulling force of drawstring cord 120 on top sheet 100 at the middle section of mattress top edges. The above-mentioned pulling enables top sheet 100 to cover the mattress taut. Using attachment devices with drawstring by the mattress sides eliminates the need of lifting the mattress, and is easy and simple to use.

In an example, the attaching mechanism of the sheet system is as follows. The size of cord 120 allows it to surround mattress side panels with nontrivial amount of tension just by itself; pulling and trapping accessible drawstring sections 122 onto hooks 222 at bed corners reinforces the above-mentioned tension and furthermore pulls top sheet 100 downwards at four sides therefore top sheet 100 is able to cover the mattress taut. The symmetric arch shape of cord casings 140 with apogee 146 in the middle further strengths downward pulling force of cord 120 on the middle sections of the mattress top edges.

In an example of the easy change mattress sheet attachment system, the initial installation includes the following steps. First, thread the loose end of strap 212 through a proper belt loop 214 according to the shape of the mattress. Then mount buckle 224 of buckle-hook 220 onto strap 212. Next, remove the mattress off the box spring and place bottom mat 200 underneath the mattress with drawstring-trapping devices located at four bed corners. Then reinstall back the mattress on top of bottom mat 200 with buckle-hook 220 extending out of the bed corners. The above-mentioned maneuver only needs to be conducted once at the initial installation and then one can attach and detach top sheet without having to disturb the mattress.

In an example, the top sheet 100 can be assembled over the mattress. First put top sheet 100 on the mattress top panel. Second, pull down one accessible drawstring section 122 from top sheet 100 at a bed corner and trap it onto mating buckle-hook 220 on bottom mat 200. Repeat the drawstring pulling and trapping at four bed corners. FIG. 3 shows an accessible drawstring section 122 being trapped by a buckle-hook 220 at a bed corner. The above-mentioned steps apply to routine top sheet changing. However, during the initial attachment of top sheet 100, to ensure a tight and snug fit of top sheet 100 onto the mattress, one may adjust the positions of hooks 222 via straps 212 and buckles 224. Also, at the initial use of the sheet system, if the effective length of cord 120 is not fixed, one may also adjust effective length of cord 120 through cord lock 130. The sewn-on cord casings 140 ensure that top sheet 100 covers the mattress evenly on all four sides.

Finally, to enhance the presentation of the assembled top sheet 100 and also for making the bed after use, the bed may be arranged by pulling down two to three side edges of top sheet 100 by the bed to remove wrinkles on top sheet 100 and make the bed top wrinkle-free, smooth and aesthetically pleasant.

To change the sheet, simply detach accessible drawstring sections 122 from buckle-hook 220 at four bed corners, and top sheet 100 is ready to be carried to washer to be washed.

Since top sheet 100 can be changed without disturbing the mattress with four simple drawstring attaching or detaching steps, this sheet attachment system allows easy and quick sheet changing. It allows the aesthetically pleasant sheet-covered bed to be installed and to be removed without much effort for people whose daily jobs require a lot of sheet changing and for elderly and people with disabilities who want to live an independent life. It also makes sheet changing much easier for bunk bed users and users who have beds that have one or more sides up against wall.

The operations shown and described herein are provided to illustrate one of many operation possibilities. It is noted that the operations are not limited to the ordering shown. Other operations may also be implemented.

Other examples of the easy change sheet attachment system may include one top sheet and one bottom mat, and may have similar operation as the examples described above. Other examples can be any combination of any top sheet in FIGS. 20A-20D and any bottom mat in FIGS. 21A-21E.

Figure 20B:
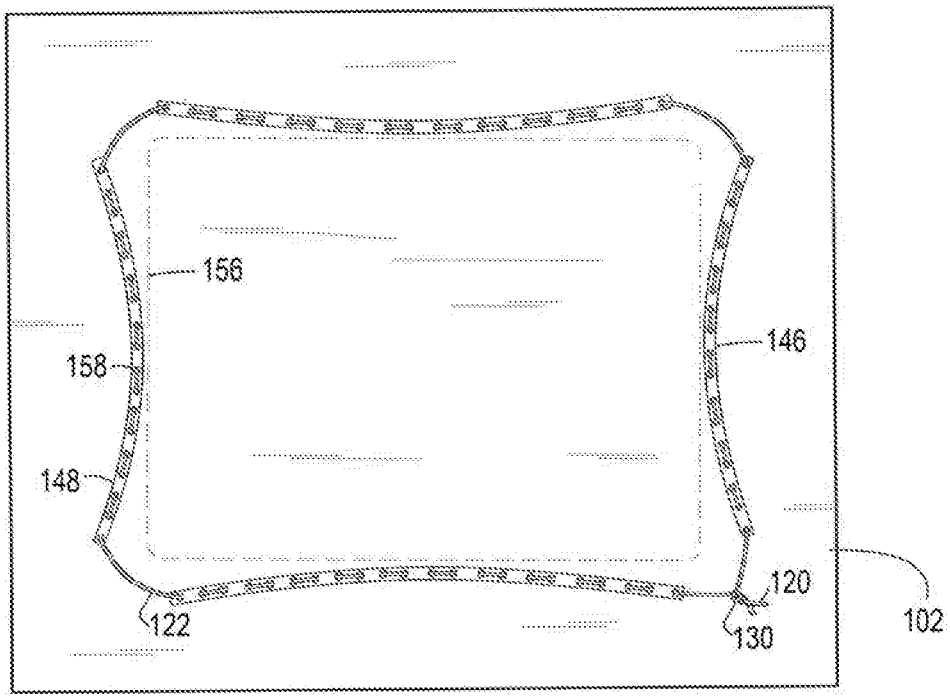
FIG. 20B is a top down view of the underside of the flattened top sheet with arch-shaped stripes of a material having eyelets and a drawstring cord being laced through the eyelets of the stripes.
Figure 20C:
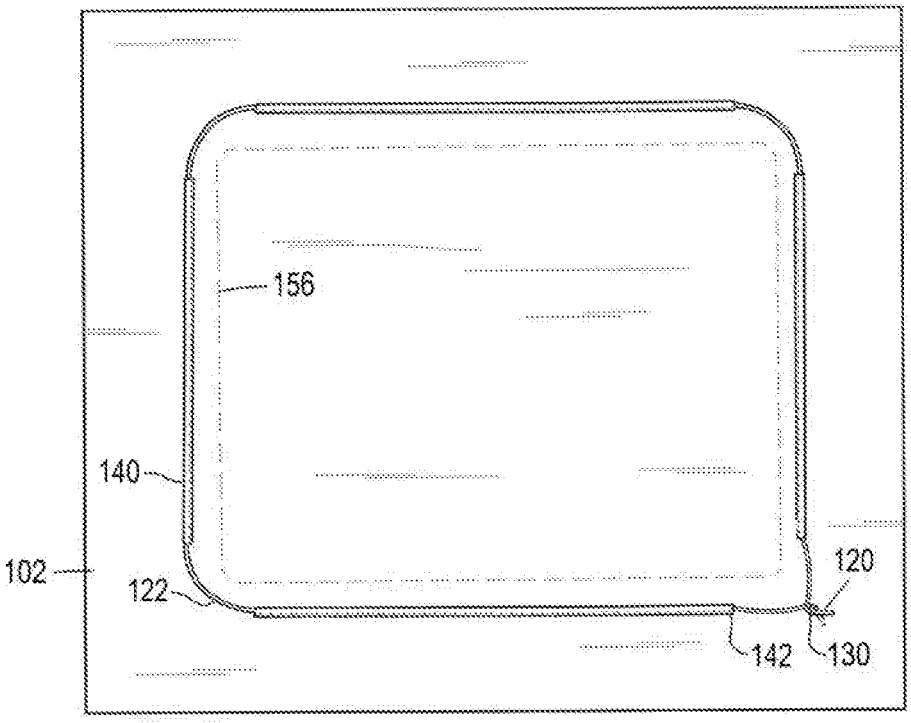
FIG. 20C is a top down view of the underside of the flattened top sheet with cord casings in a straight-line shape and a drawstring cord being inserted through the casings.
Figure 20D:
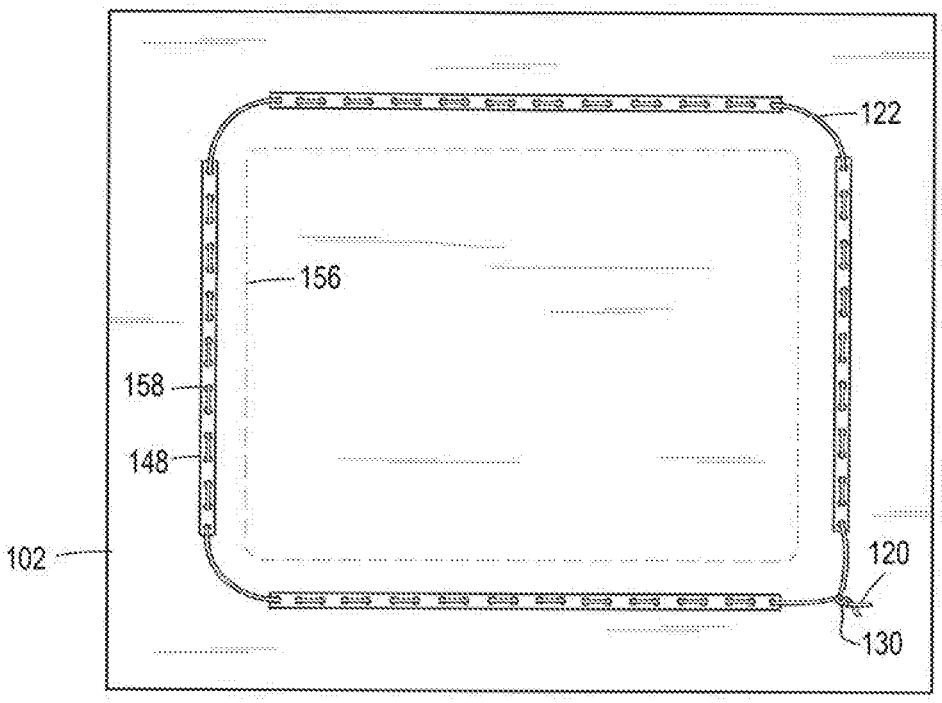
FIG. 20D is a top down view of the underside of the flattened top sheet with straight-line shaped stripes of material containing eyelets and a drawstring cord being laced through the eyelets.

Another example of top sheet implementations illustrated in FIGS. 20B to 20D show that while the upper attachment devices remain to be accessible sections of drawstring 122, the cord casings can be of various shapes and materials. FIG. 20B shows that the top sheet has sewn-on arch-shaped stripes of material with eyelets 148 instead of cord casings, wherein a drawstring path is defined by lacing drawstring cord 120 through a set of eyelets 158. FIG. 20C shows the top sheet has straight-line cord casings instead of arch-shaped ones. FIG. 20D shows top sheet 100 has the path of cord 120 defined by straight-line-shaped stripes of material with eyelets 148. The eyelets can be formed by eyelet fabric, or by any other suitable means.

Figure 21A:
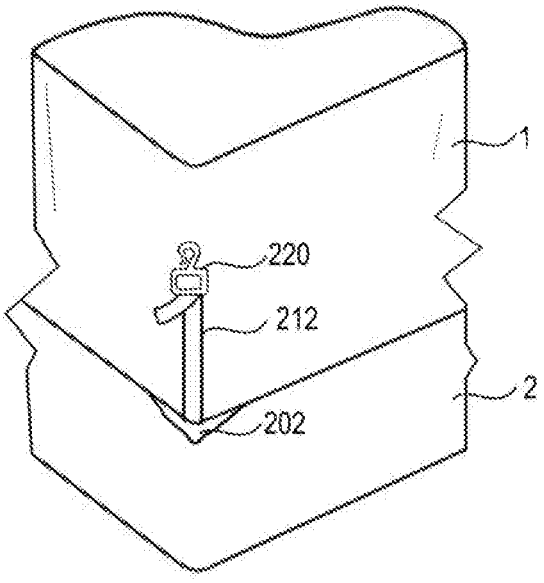
FIG. 21A is a partial enlarged perspective view of a bed corner showing each drawstring-trapping device of the system of FIG. 1 having a belt, a set of belt loops, and a buckle-hook.
Figure 21B:
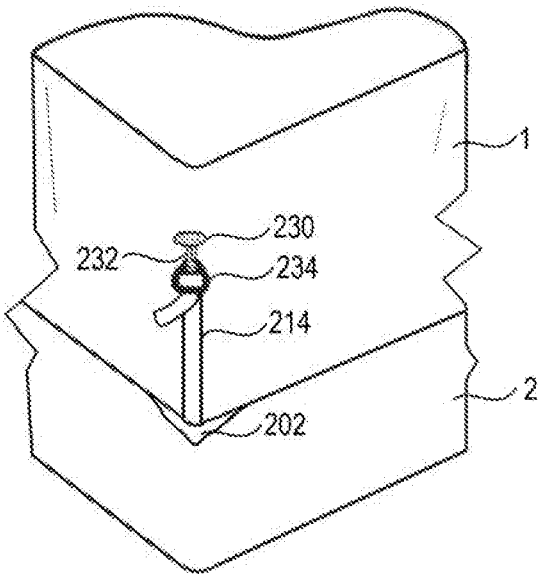
FIG. 21B is a partial enlarged perspective view of a bed corner showing each drawstring-trapping device on the bottom mat having a toggle button, a buckle and a belt.
Figure 21C:
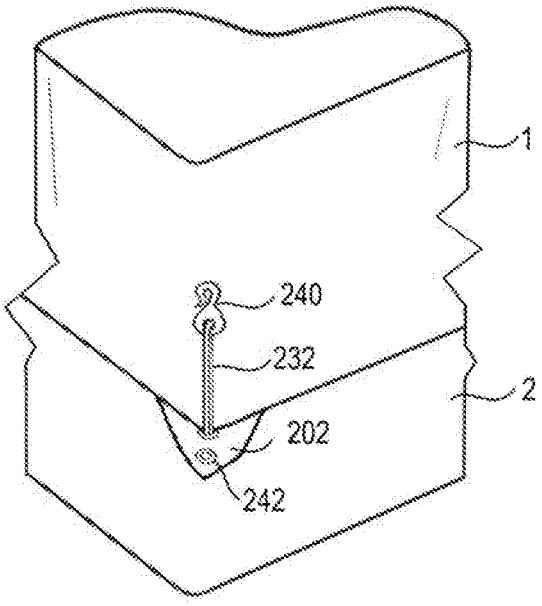
FIG. 21C is a partial enlarged perspective view of a bed corner showing each drawstring-trapping device on the bottom mat having a set of grommet holes, a cord with one end to be trapped by a grommet hole and a hook.
Figure 21D:
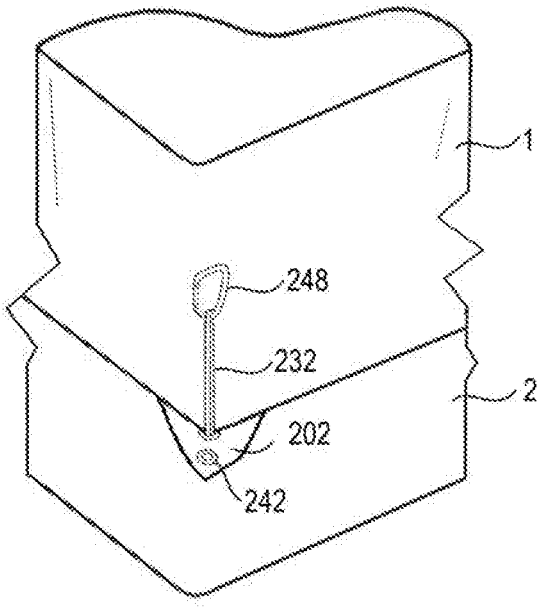
FIG. 21D is a partial enlarged perspective view of a bed corner showing each drawstring-trapping device on the bottom mat having a set of grommet holes, cord with one end to be trapped by a grommet hole, and a snap hook.
Figure 21E:
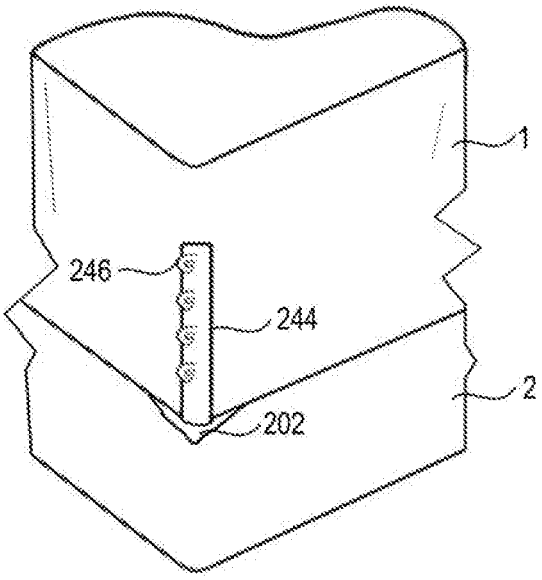
FIG. 21E is a partial enlarged perspective view of a bed corner showing each drawstring-trapping device on the bottom mat having a belt with a set of built-in hooks.

The example bottom mats illustrated in FIGS. 21B to 21E are different in their drawstring-trapping devices at the corners. FIG. 21B shows a bottom mat that has barrel-shaped toggle button 230 as the main component of the lower attachment means. FIG. 21B also shows that cord 232 has one end connect to button 230 and the other end stabilized by the grommet bar (not shown) trapped by one of the grommet holes 242 distributed on bias at the corner of bottom mat 200. FIG. 2C shows another lower attachment means that has hook 240. FIG. 21D shows another lower attachment means that has a snap hook 248. FIG. 21E shows that the lower attachment means includes belt 244 having a set of hooks 246 for providing positioning flexibility for drawstring attachment. Belt 244 may be sewn onto the bottom mat like the one in the example of FIG. 21A, or it can be stabilized on the bottom mat by any other means.

The following examples are provided as non-limiting illustration. The top sheet, the casing could be made with double-fold bias tape or any other materials, or the casing could be substituted with eyelet fabric stripes or any other suitable materials. The cord may be made with elastic material or any other suitable materials. The accessible sections of drawstring may be formed at any places suitable and can be of any number. The sheet part could be flat with right or round corners, or the sheet could have corner pieces cut out to reduce the pleats at the corners. The cord could be of a fixed length, or have two open ends enclosed by knot tying, by using a cord lock, or by any other means.

For the bottom mat, any number of lower attachment means may be provided, not just four at the corner. The materials of the bottom mat may be a rigid fabric with a good grip or any materials that are suitable. In an example where many uniformly sized beds are employed, the lower attachment means may be a simple non-adjustable drawstring-trapping device. Since the bottom mat is just a vector for lower attachment means, the bottom mat is delectable when the lower attachment means can be mounted onto places such as the bed frames or any other suitable places.

It is noted that with the sheet attachment devices located at the side of mattress, sheet installation and removal are easy because no mattress lifting is required.

The easy-to-use attachment devices with drawstring trapping allow sheet-changing to be quick and easy, also the drawstring trapping mechanism provides secure sheet coverage by preventing sheet dislodging, sheet attachment devices with drawstring also provide tight coverage over mattress, arch shape of the cord casings with the apogees close to the middle of mattress top edges strengthens the pulling tension of the cord at the middle sections of the mattress.

In an example, adjustable attachment devices with drawstring and one large piece of top sheet provide sheet fitting flexibility over mattresses of various shapes and geometries including crib mattresses.

With the use of a large one piece of top sheet, all visible panels of the mattress are smoothly and snuggly covered, presenting an aesthetically pleasant bed. The top sheet may be large enough to not only cover all the visible panels of the mattress, but also cover side panels of the box spring underneath, making bed skirt delectable.

The use of the top sheet having only fabric and durable drawstring allows it to be washed at regular settings and the top sheet is the only part that needs to be washed.

In an example, the easy change mattress bed sheet system of various examples provides quick and easy ways to install and to remove bed sheets. In addition, it provides tight sheet coverage over the mattress and presents an eye-pleasing bed as the mattress and even the box spring are snugly and smoothly covered by one piece of bed sheet. Furthermore, the easy change mattress sheet attachment system has the additional advantages in that:

In an example, the easy change mattress bed sheet system permits changing bed sheet without having to lift up the mattress;

In an example, the easy change mattress bed sheet system enables the bed sheet system parts to be replaced during the wear and tear, e.g. the cord is detachable from the top sheet, which extends the lifespan of the bed sheet system. It is noted that the cord may also be made of durable material and last for many years.

In an example, the easy change mattress bed sheet system provides secure attachment devices with drawstring at bed corners that prevents dislodging.

In an example, the easy change mattress bed sheet system provides easy application of bed sheet on cornered beds and on bunk beds.

In an example, the easy change mattress bed sheet system provides flexibility to fit mattresses of various geometries and mattresses topped with various accessories.

The lower attachment means on bottom mat may include, but is not limited to hooks, snap hooks, toggle buttons, etc. The arc shape of the cord casings in an example strengthens drawing tension of the cord at the middle of mattress top edges.

It is noted that the examples shown and described are provided for purposes of illustration and are not intended to be limiting. Still other examples are also contemplated.

The invention claimed is:

1. A mattress bed sheet attachment system comprising:

a removable top sheet having a substantially large piece of fabric sheet configured to cover all visible panels of a mattress;

a cord or a set of cords for forming a drawstring on the top sheet and for forming a plurality of accessible sections of the drawstring that serve as upper attachment means;

means for defining a path of the cord on the top sheet and for defining positions of the accessible sections of the drawstring;

a plurality of drawstring-trapping devices for fastening the accessible sections of the drawstring; and a support material for mounting the drawstring-trapping devices by the bed side so that the top sheet covers the mattress taut when all accessible sections of the drawstring are trapped taut and are pulled down by mating drawstring-trapping devices;

wherein tight coverage of the top sheet is provided over the mattress and can be easily attached and detached from the mattress without having to lift the mattress at all.

2. The mattress bed sheet attachment system of claim 1, wherein the removable top sheet is large enough to cover not only all visible panels of the mattress, but also side panels of a box spring, eliminating the need for a bed skirt.

3. The mattress bed sheet attachment system of claim 1, wherein the cord is made of durable elastic bungee shock cord.

4. The mattress bed sheet attachment system of claim 1, wherein the cord forms a closed drawstring loop by joining two ends together using a knot tie or a dual hole cord stopper.

5. The mattress bed sheet attachment system of claim 1, wherein the means for defining the path of the cord on the top sheet has four sewn-on cord casings each spanning across one mattress side panel longitudinally when the top sheet is fully associated with the mattress, and each of the sewn-on cord casings has openings at both ends for the cord to be inserted therethrough.

6. The mattress bed sheet attachment system of claim 5, wherein the sewn-on cord casings are formed by sewing double-fold bias tape onto the underside of the top sheet.

7. The mattress bed sheet attachment system of claim 5, wherein the sewn-on cord casings are sewn onto the top sheet in a symmetric arch shape with apogees close to the middle of corresponding mattress top edges when the top sheet is fully attached onto the mattress.

8. The mattress bed sheet attachment system of claim 5, wherein the sewn-on cord casings are sewn onto the top sheet in a straight-line shape.

9. The mattress bed sheet attachment system of claim 1, wherein the means for defining the path of the cord on the top sheet has four sewn-on stripes of material with eyelets each spanning across one mattress side panel longitudinally when the top sheet is fully associated with the mattress and the stripes of material with eyelets define the path by letting the cord to be laced through the eyelets.

10. The mattress bed sheet attachment system of claim 9, wherein the sewn-on stripes of a material containing eyelets are sewn onto the top sheet in a symmetric arch shape with apogees close to the middle of corresponding mattress top edges when the top sheet is fully attached onto the mattress.

11. The mattress bed sheet attachment system of claim 9, wherein the sewn-on stripes of material with eyelets are sewn onto the top sheet in a straight-line shape.

12. The mattress bed sheet attachment system of claim 1, wherein the support material for mounting the drawstring-trapping devices is a flat rigid piece of mat about the size of the mattress top panel and is configured to align with the mattress and to lay under the mattress or a box spring.

13. The mattress bed sheet attachment system of claim 1, wherein the drawstring-trapping device has a drawstring trapping element and means for supporting the drawstring trapping element on the support material.

14. The mattress bed sheet attachment system of claim 13, wherein the drawstring-trapping element is a hook, a snap hook, a toggle button, or a buckle-hook with the hook and a buckle as one piece.

15. The mattress bed sheet attachment system of claim 13, wherein the means for supporting the drawstring trapping element on the support material is adjustable via a device that includes a strap or a cord with one end fastened on the support material and the other end connected with the drawstring trapping element.

16. The mattress bed sheet attachment system of claim 15, wherein the device that includes a strap or a cord includes a set of belt-loops sewn on the support material for adjusting a position of the strap or the cord.

17. The mattress bed sheet attachment system of claim 15, wherein the device that includes a strap or a cord further includes a buckle for mounting onto the strap or the cord, and for adjusting the position of drawstring trapping element via the strap or the cord.

18. A method of releasably attaching a mattress bed sheet onto a mattress without having to lift up the mattress, comprising:

providing a mattress sheet attachment system with a top sheet having a plurality of cord-path-defining means, a cord or a set of cords forming a drawstring or drawstrings by passing through the cord-path-defining means, a plurality of accessible sections of the drawstring or drawstrings formed by the sections of the cord that are exposed between two adjacent cord-path-defining means, and a support material having a plurality of drawstring-trapping devices;

providing the drawstring-trapping devices located by the mattress;

putting the top sheet onto a mattress top panel with the drawstring or drawstrings on the underside of the top sheet;

pulling down one of the accessible sections of the drawstring or drawstrings at a corner of the mattress and trapping the accessible sections of the drawstring or drawstrings onto a mating drawstring-trapping device;

pulling and trapping accessible sections of the drawstring or drawstrings onto their mating drawstring-trapping device at four bed corners; and arranging an aesthetically pleasant bed by pulling down two to three side edges of the top sheet;

wherein the top sheet is associated onto the mattress taut without having to lift up the mattress and can be releasably attached and detached.

19. The method of claim 18, wherein each drawstring-trapping device contains elements to adjust its position.

20. The method of claim 18, wherein the support material is a bottom mat about the size of the mattress top panel, and the support material is configured to lay under the mattress or a box spring.

* * * * *